United States Patent [19]

Cawley

[11] Patent Number: 4,525,121

[45] Date of Patent: Jun. 25, 1985

[54] APPARATUS FOR PICKING UP, CARRYING AND RELEASING ARTICLES

[76] Inventor: Wesley D. Cawley, 721 Grigsby Dr., Port Neches, Tex. 77651

[21] Appl. No.: 593,212

[22] Filed: Mar. 26, 1984

[51] Int. Cl.[3] ..... B66C 1/59

[52] U.S. Cl. ..... 414/564; 294/107

[58] Field of Search ..... 414/560–562, 414/564; 294/61, 107

[56] References Cited

U.S. PATENT DOCUMENTS 3,193,319 7/1965 Frock et al. ..... 294/107 X 3,777,908 12/1973 Keller ..... 414/564 X

*Primary Examiner*—Robert G. Sheridan

*Attorney, Agent, or Firm*—Fulbright & Jaworski

[57] ABSTRACT

A support body having a plurality of grasping fingers on opposite sides which are shaped in the form of an arc of a circle. The fingers move in a circular path for grasping and releasing articles with a minimum of clearance along the side of the articles. An arm supports each of the fingers by one end and has the second end of the arm rotationally supported from the support body at an angle. The first end of the arm is at an angle to the plane of the supported finger and the second end is at an angle to the first end. A lever is connected between the support body and the first ends of each arm for rotating the first ends about the second ends. A conveying system may be used with the pick up and release apparatus having a conveyor with spaced rollers in which compression plates are positioned at each end of the rollers for compressing the article for pickup.

7 Claims, 4 Drawing Figures

APPARATUS FOR PICKING UP, CARRYING AND RELEASING ARTICLES

BACKGROUND OF THE INVENTION

Various types of pivoting clamps are used for material handling apparatus for picking up and releasing articles such as bagged products. However, bagged products are frequently stored in a confined space in which it is difficult to pick up and release the bags as there is not a sufficient clearance at the edge of the bags for the material handling apparatus to move around the edges of the bag for gripping or releasing. Not only is it difficult to grasp or release a bag that is stacked in among other bags, conventional material handling equipment frequently engages and damages adjacent bags.

The present invention is directed to an improved apparatus for picking up, carrying and releasing articles, particularly bagged products, which can be stored in confined areas by utilizing grasping fingers which can be extended and retracted about articles with a minimum of clearance along the edges of the article.

SUMMARY

The present invention is directed to a material handling apparatus for picking up, carrying and releasing articles from and into a confined area and includes a support body having at least one grasping finger on opposite sides of the support body. The fingers are shaped in the form of an arc of a circle. An arm supports each of the fingers and the arms include first and second ends with the first end of each arm connected to one end of each finger and the first end of each arm is positioned at an angle to the plane containing the supported finger. The second end of each arm is at an angle to the first end of the arm and the second ends of the arms are rotationally supported from the support body. Lever means are connected between the support body and the first end of each arm for rotating the first end about the second end whereby the first end of each arm and the fingers follow a circular path for grasping and releasing articles.

A further object is wherein the second end of each arm is directed downwardly at an angle from the horizontal axis of the support body for enabling the finger of rotation to be placed close to the article and minimize the clearance required on the sides of the article.

A still further object is wherein the lever means includes rotatable shaft means supported from the body with a first lever for each finger secured to the rotatable shaft means and a second lever pivotally connected between each first lever and the first end of one finger.

Still a further object of the present invention is the provision of a conveying system for use in combination with the material handling apparatus for preparing articles for pickup and including a conveyor having a plurality of spaced rollers for receiving articles to be picked up by the material handling apparatus. An article compressing plate is positioned at each end of the rollers and each plate includes openings at the top edge of the plates for allowing the passage of the fingers for picking up the articles from the conveyor. Means are connected to the plates for moving the plates towards the ends of the rollers for compressing an article positioned on the roller whereby the fingers may be extended around the edges of the article.

Yet a still further object is the provision of an apparatus which includes a longitudinal extending support body with a plurality of grasping fingers on opposite sides of the support body in which each of the fingers are arcuately shaped in the form of an arc of a circle. An arm supports each of the fingers with the arm having first and second ends. The first end of each arm is connected to and supports one end of each finger and the first end of each arm is positioned at an angle to the plane containing the supported arcuate finger. The second end of each arm is at an angle to the first end of the arm, and the second end of each arm is rotationally supported from the support body at an angle. Lever means for extending and retracting the fingers includes first and second rotatable shafts supported from the body with the shafts being connected together to rotate in synchronism. A plurality of first levers are secured to each of the shafts and a second lever is pivotally connected between each of the first levers and one of the first ends of each of the fingers.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present apparatus is particularly useful and will be described in connection with picking up, carrying and releasing bagged products, it is to be understood that it may also be used with other types of articles.

Figure 1:
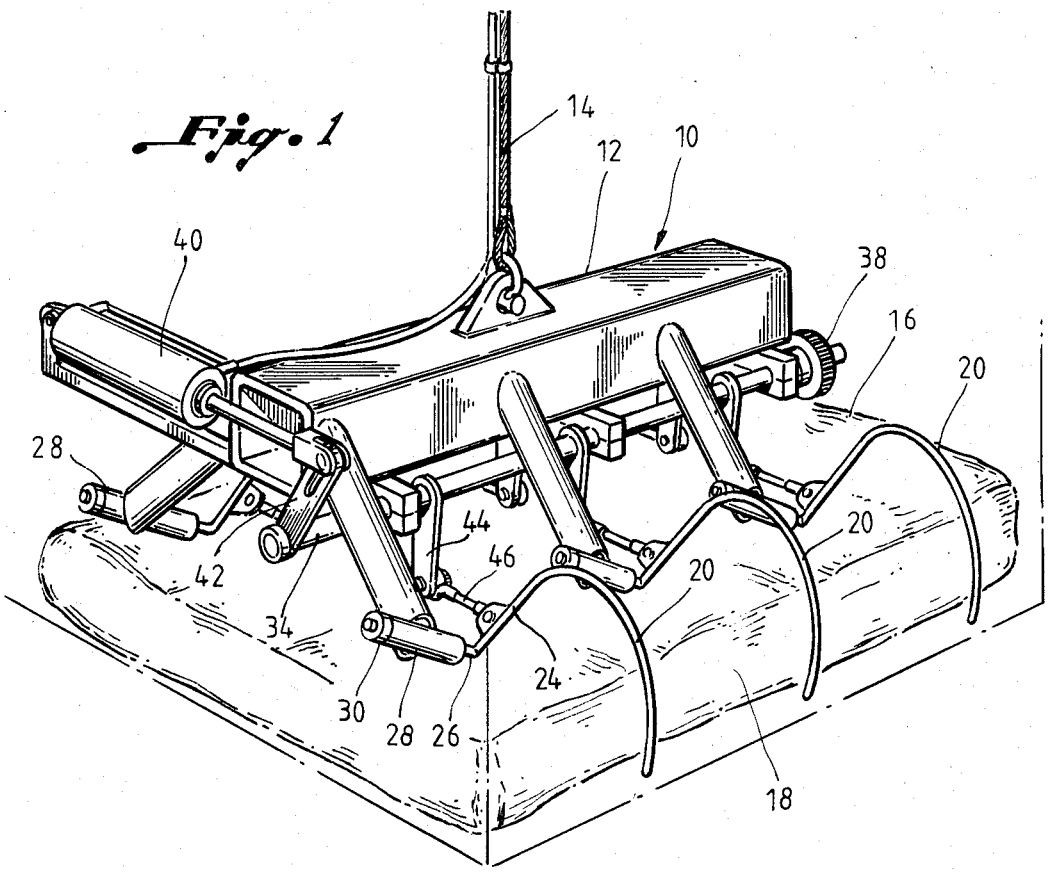
FIG. 1 is a perspective view of the apparatus of the present invention shown in the open position above an article to be picked up or being released.
Figure 4:
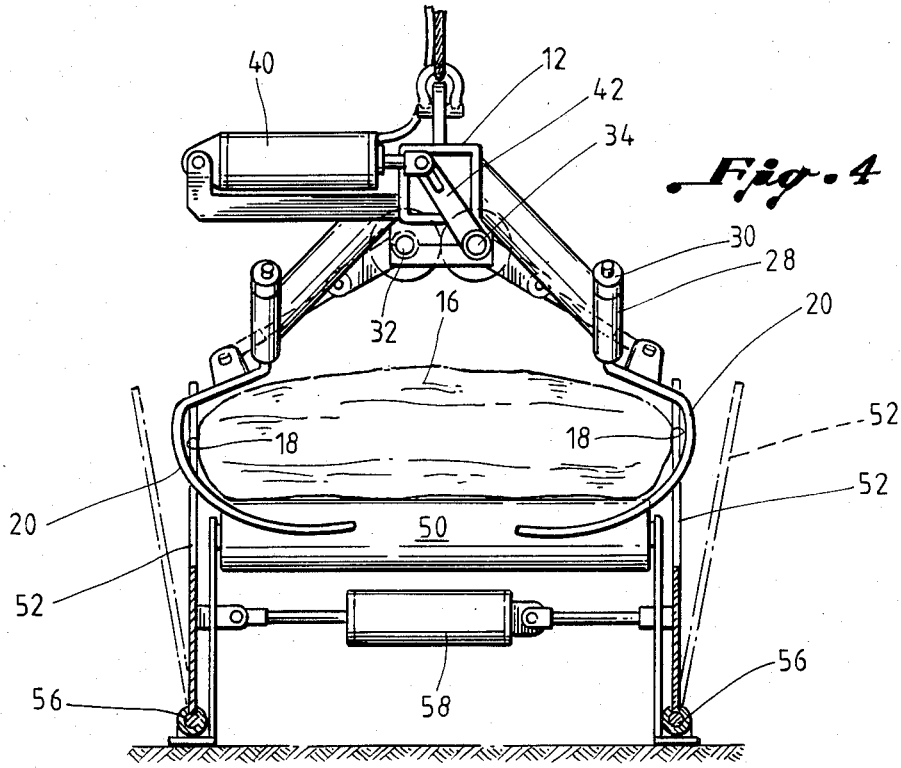
FIG. 4 is a cross-sectional view taken along the line 4—4 of FIG. 3.

Referring now to the drawings, and particularly to FIG. 1, the reference numeral 10 generally indicates the apparatus of the present invention which generally includes a longitudinally and generally horizontally extending support body 12 which may be connected to any suitable hoisting and moving equipment such as by a cable 14 for moving the apparatus 10 and/or a bag 16 from one location to another location. At least one grasping finger 20 and preferably a plurality of such fingers are provided on opposite sides of the support body (as best seen in FIG. 4) for picking up and releasing a bag 16 around the opposite sides or edges 18 of the bag 16. The fingers are shaped in the form of an arc of a circle and are extended and retracted in a circular path for grasping and releasing a bag 16 thereby requiring a minimum of clearance space about the edges 18 of the bag 16. An arm generally indicated by the reference numeral 22, includes a first end 24 and a second end 26, is connected to and supports each of the fingers 20. The first end 24 of each arm 22 is connected to and supports one end of each grasping finger 20 and the first end 24 is positioned at an angle to the plane of or containing the supported arcuate finger 20. The second end 26 of each arm 22 is at an angle to the first end 24 and the second ends 26 are rotationally supported in a support 28 and is preferably secured therein to a thrust bearing 30.

Suitable lever means are connected between the support body 12 and each of the first ends 24 of the arms 22 for rotating the first ends 24 about the second ends 26 whereby the first ends 24 and the fingers 20 follow a circular path for grasping and releasing articles.

Figure 2:
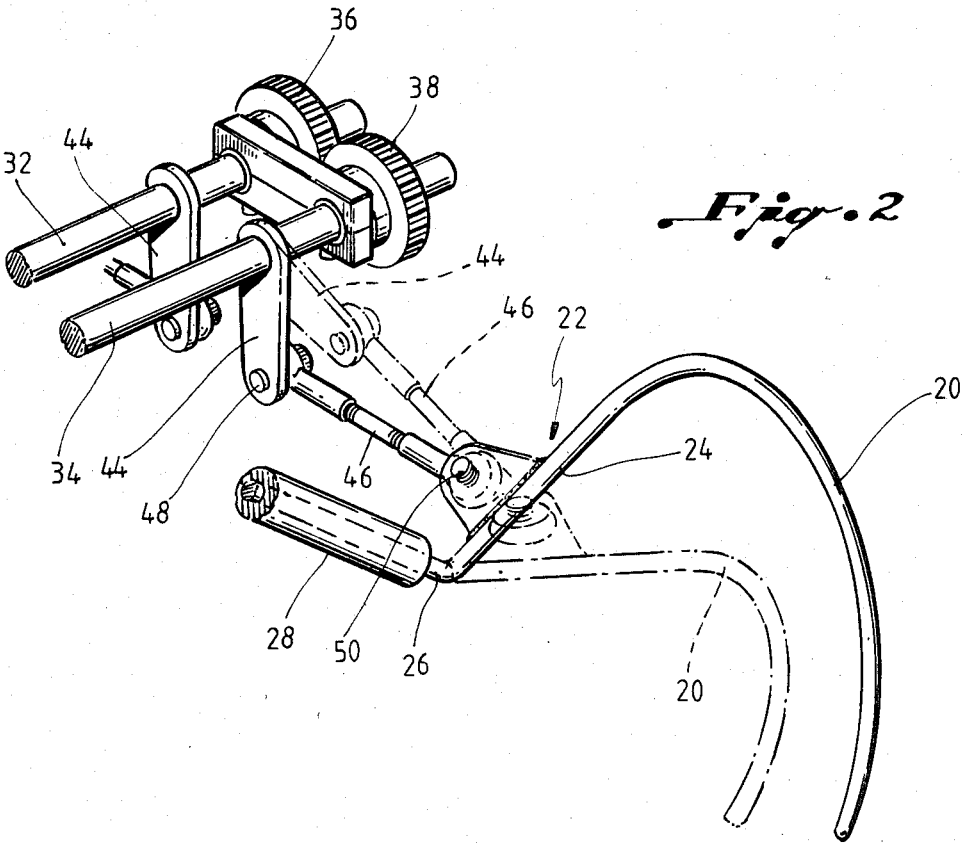
FIG. 2 is a perspective fragmentary elevational view of a portion of the apparatus illustrating the retraction and extension of one of the grasping fingers.

Preferably, the lever means include a first 32 and a second 34 rotatable shaft supported from the body 12 and the shafts 32 and 34 are connected together to rotate in synchronism such as by gears 36 and 38, as best seen in FIG. 2. Suitable means for rotating one of the shafts such as 34 may be provided such as by a hydraulic piston and cylinder assembly 40 connected to a lever 42 which in turn is connected to one of the shafts such as 34, as best seen in FIGS. 1 and 4. Therefore, actuation of the piston and cylinder assembly 40 rotates the shafts 32 and 34 in one direction for retracting the arms 20 and in a second direction for extending the arms 20. A plurality of first levers 44, one for each arm 20, are secured to the shafts 32 and 34 and a second lever 46 is pivotally connected by a pivot 48 to each of the levers 44 and also to one of the first ends 24, by a pivot connection 50, of each of the fingers 20. As best seen in FIG. 1, and in the solid outline in FIG. 2, the fingers 20 are shown in their retracted position extending downwardly whereby the apparatus 10 may be placed over a bag 16 allowing the fingers 20 to move along the outer edges 18 of the bag 16. When the hydraulic piston and cylinder assembly 40 is actuated to rotate the shafts 32 and 34, and extend the first levers 44 and second levers 46, the first ends 24 of the arm 22 and the fingers 20 follow a circular path to move to an extended position as best seen in FIG. 4 and in dotted outline in FIG. 2. The fingers 20 follow a circular path around the outer edges 18 of the bag 16 and rotate to a position beneath the bag 16 to hold and carry the bag 16 or to release the bag 16.

Generally, when the bag 16 is filled with loose material this causes the bag sides 18 to take a generally radiused shape. This would appear to provide an ideal coacting of the circularly moving fingers 20 for fitting closely about the sides 18 and thus requiring a minimum of clearance about the sides 18. However, to reduce the amount of required clearance on the sides 18 to the minimum, the second ends 26 and the bearing supports must be at an angle to the longitudinal or horizontal axis of the body 12. That is, if the ends 26 and bearings 28 were positioned parallel to the longitudinal axis of the body 12, because of the thickness of the bearing 28 the center of rotation of ends 26 would be spaced about the bags 18 a fixed distance and that fixed distance would be required as clearance on the sides 18. However, by angling the bearings 28 downwardly, the point of rotation of the second ends 26 can be lowered to adjacent the top of the bag 16 and the fingers 20 will closely rotate around the sides 18 with less clearance.

Figure 3:
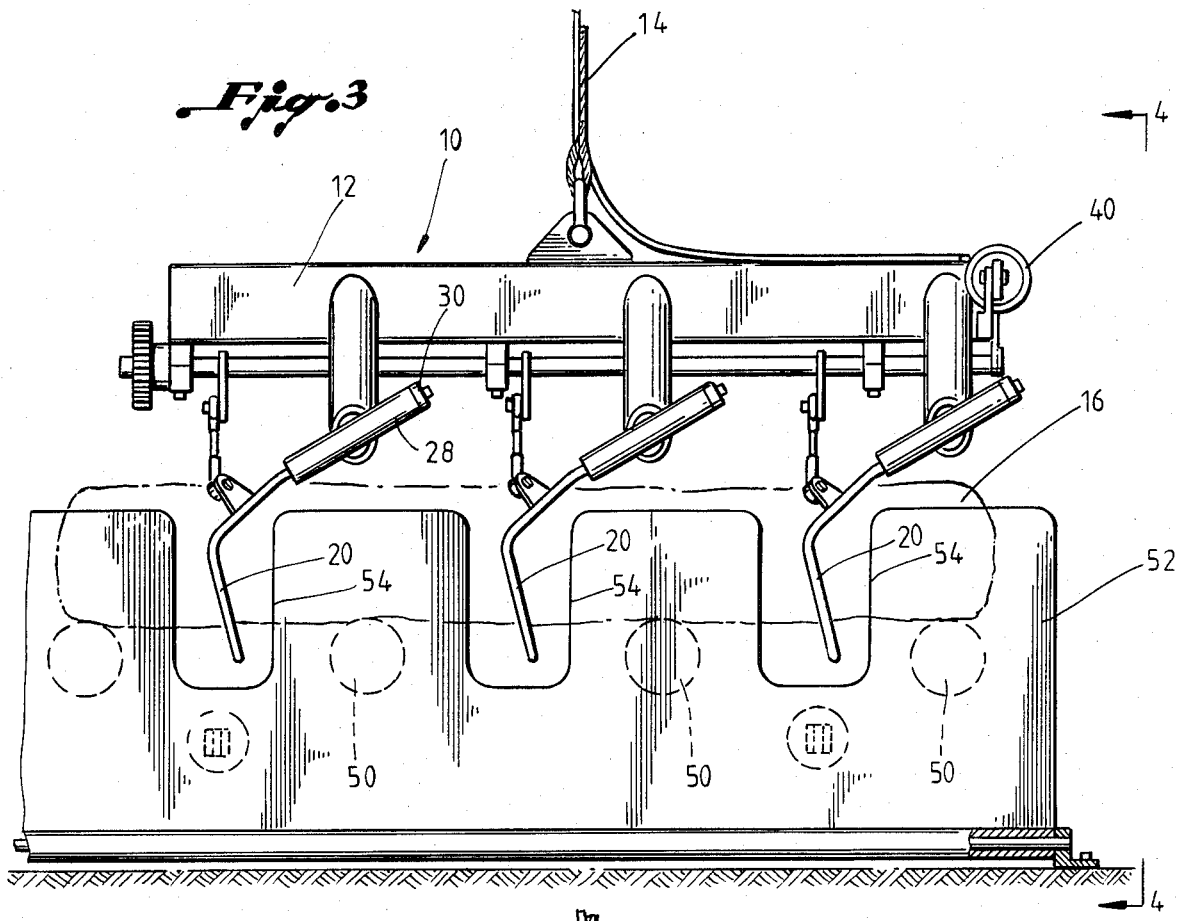
FIG. 3 is an elevational view of the apparatus of the present invention in position grasping an article on the improved conveying system of the present invention.

Since the fingers 20 move in a circular path which is fixed by the dimensions of the material handling apparatus 10, the inside dimension between opposite fingers 20 is fixed. Therefore, in order for the fingers 20 to enclose and grasp a bag 16 the overall width of the bag between adjacent sides 18 must not be greater than the interior dimension between opposing fingers 20. In initially manufacturing bag products, or at other times, the outside edges 18 of the bag 16 may bulge out to provide a width which will not allow the fingers 20 to encircle and grasp the edges 18. Referring now to FIGS. 3 and 4, a conveyor system is shown for handling bags 16 which insures that the width of a bag 16 is small enough to be grasped by the apparatus 10. Thus, a conveyor having a plurality of spaced rollers 50 is shown which conveys a bag 16 to a location to be picked up by the apparatus 10. A compressing plate 52 is positioned on each side of the conveyor at each end of the rollers 50. Each plate 52 includes a plurality of openings 54, one of which registers with each finger 20 for allowing the passage of the fingers 20 therethrough for picking up a bag 16. Means are connected to the plates 52 for compressing a bag 16 positioned on the rollers 50 to a satisfactory width for engagement by the fingers 20. Thus, the plates 52 may be pivotally supported about pivots 56 for movement towards and away from the ends of the rollers 50. The plates 52 are left in a retracted position as shown in dotted outline in FIG. 4 until a bag 16 is conveyed therebetween. Thereafter, the plates 52 are moved together by any suitable means such as a hydraulic piston and cylinder assembly 58 connected therebetween to move the plates 52 inwardly to compress the bag 16 and allow the apparatus 10 to move into place, extend the fingers 20 around the edges 18 of the bag 16 and thereafter the plates 52 may be again retracted and the apparatus 10 may pick up the bag 16 and move it to the desired location. Once the bag has been compressed to its proper size, it will generally maintain that size and the apparatus 10 can pick up and release the bag 16 in various confined areas with a minimum of edge clearance without damaging adjacent bags.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. An apparatus for picking up, carrying and releasing articles comprising, a support body, at least one grasping finger on opposite sides of the support body, said fingers shaped in the form of an arc of a circle, an arm supporting each of the fingers, said arms having first and second ends, the first end of each arm connected to one end of each finger, the first end of each arm being positioned at an angle to the plane of the supported finger, the second end of each arm being at an angle to the first end of the arm, said second ends of the arms being rotationally supported from the support body, and lever arms connected between the support body and the first end of each arm for rotating said first end about the second end whereby the first end of each arm and said fingers follow a circular path for grasping and releasing articles.

2. The apparatus of claim 1 wherein, the second ends of said arms are angled to the longitudinal axis of the support body for minimizing the side clearance required about the sides of an article.

3. The apparatus of claim 1 wherein the lever means includes, a first lever for each finger secured to the rotatable shaft means, a second lever pivotally connected between each first lever and the first ends of one finger.

4. The apparatus of claim 1 including a conveying system for use with said apparatus for preparing articles for pickup by the apparatus comprising, a conveyor having a plurality of spaced rollers for receiving articles to be picked up by said apparatus, an article compressing plate positioned at each end of the rollers, each plate having openings at the top edge of said plate for allowing the passage of said fingers for picking up said article, and means connected to said plates for moving said plates towards the ends of said rollers for compressing an article positioned on the rollers.

5. An apparatus for picking up, carrying, and releasing articles comprising, a longitudinally extending support body, a plurality of grasping fingers on opposite sides of the support body, each of said fingers shaped in the form of an arc of a circle, an arm supporting each of said fingers, each arm having first and second ends, the first end of each arm connected to and supporting one end of each finger, the first end of each arm being positioned at an angle to the plane of the supported finger, the second end of each arm being at an angle to the first end of said arm, said second ends of each arm being rotationally supported from the support body at an angle to the body, and lever means connected between the support body and the first ends of each arm for rotating said first ends about the second ends whereby the first ends and said fingers follow a circular path for grasping and releasing articles.

6. The apparatus of claim 5 wherein the lever means includes, first and second rotatable shafts supported from the body, said shafts being connected together to rotate in synchronism, a plurality of first levers secured to each of the shafts, a second lever pivotally connected between each of the first levers and one of the first ends of each of the fingers.

7. The apparatus of claim 6 including a conveying system for use with said apparatus for preparing articles for pickup by the apparatus comprising, a conveyor having a plurality of spaced rollers for receiving articles to be picked up by said apparatus, an article compressing plate positioned at each end of the rollers, each plate having openings at the top edge of said plate for allowing the passage of said fingers for picking up said article, and means connected to said plates for moving said plates towards the ends of said rollers for compressing an article on the rollers.

* * * * *